US009776101B2

(12) United States Patent
Richards et al.

(10) Patent No.: US 9,776,101 B2
(45) Date of Patent: Oct. 3, 2017

(54) METHOD TO IMPROVE THE CONTRAST RATIO IN A THEATRE

(71) Applicant: DOLBY LABORATORIES LICENSING CORPORATION, San Francisco, CA (US)

(72) Inventors: Martin J. Richards, Gig Harbor, WA (US); Douglas J. Gorny, Pacifica, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/501,085

(22) PCT Filed: Aug. 3, 2015

(86) PCT No.: PCT/US2015/043415
§ 371 (c)(1),
(2) Date: Feb. 1, 2017

(87) PCT Pub. No.: WO2016/022471
PCT Pub. Date: Feb. 11, 2016

(65) Prior Publication Data

US 2017/0225093 A1 Aug. 10, 2017

Related U.S. Application Data

(60) Provisional application No. 62/033,281, filed on Aug. 5, 2014.

(51) Int. Cl.

| | |
|---|---|
| ***A63J 25/00*** | (2009.01) |
| ***A63J 1/00*** | (2006.01) |
| *G03B 21/00* | (2006.01) |

(52) U.S. Cl.
CPC *A63J 25/00* (2013.01); *A63J 1/00* (2013.01)

(58) Field of Classification Search
CPC ..... A63J 5/00; A63J 5/02; A63J 25/00; G02B 19/0019; G02B 26/0816; G02B 5/124;
(Continued)

(56) References Cited

U.S. PATENT DOCUMENTS

| | | | |
|---|---|---|---|
| 1,395,513 | A | 11/1921 | Owen |
| 1,754,674 | A | 4/1930 | Farnum |

(Continued)

FOREIGN PATENT DOCUMENTS

| | | |
|---|---|---|
| AU | 3957572 | 9/1973 |
| JP | S62-500194 | 1/1987 |

(Continued)

OTHER PUBLICATIONS

Clauser, Grant "Theater Shakes with 11.2 Surround Sound, D-BOX Motion Simulator" May 1, 2013.

(Continued)

*Primary Examiner* — Kien Nguyen

(57) ABSTRACT

A light absorbing configuration for a venue in which images are projected to a display screen located at or near a front of the venue, may comprise a light absorbing structure deployed on one or more front portions on one or more of a ceiling, side walls, or a floor of the venue. The light absorbing structure comprises grooves formed at least in part by a first type of light reflective surfaces configured to receive a portion of light rays directly reflected off the display screen and a second type of light reflective surfaces configured to receive light rays reflected off the first type of light reflective surfaces.

19 Claims, 9 Drawing Sheets

(58) Field of Classification Search
CPC ..... G03B 21/00; G03B 21/10; G03B 21/60; G03B 21/2066
USPC ..... 472/59, 60, 61; 359/454, 459
See application file for complete search history.

(56) References Cited

U.S. PATENT DOCUMENTS

| | | | | |
|---|---|---|---|---|
| 5,026,152 | A * | 6/1991 | Sharkey | A63J 25/00 352/43 |
| 5,225,933 | A | 7/1993 | Myers | |
| 6,324,011 | B1 * | 11/2001 | Higuchi | G02B 5/124 359/454 |
| 7,522,339 | B2 * | 4/2009 | Kuo | G03B 21/10 359/459 |
| 7,659,669 | B2 | 2/2010 | Nishida | |
| 2011/0267550 | A1 | 11/2011 | Coleman | |
| 2014/0029103 | A1 | 1/2014 | Budleski | |

FOREIGN PATENT DOCUMENTS

| | | |
|---|---|---|
| JP | 2004-151592 | 5/2004 |
| JP | 2004-271787 | 9/2004 |
| JP | 2013-095120 | 5/2013 |

OTHER PUBLICATIONS

Clauser, Grant "Integrator's Home Theater Doubles as Showroom" Aug. 9, 2013.
Home Theater Room (old) http://moesrealm.com/home-theater/gallery/home-theater-room-old/.

* cited by examiner

METHOD TO IMPROVE THE CONTRAST RATIO IN A THEATRE

CROSS-REFERENCE TO RELATED APPLICATIONS

This application claims the benefit of priority to U.S. Provisional Patent Application No. 62/033,281 filed 5 Aug. 2014, which is hereby incorporated by reference in its entirety.

TECHNOLOGY

The present invention relates to improving contrast ratios in venues, theaters, auditoriums, etc., that comprise screens onto which images are projected.

BACKGROUND

New theaters, auditoriums, etc., are being developed by Applicants to display images with very high contrast ratios, high maximum luminance levels, and low minimum luminance levels. Many efforts to increase maximum contrast ratio of displayed images in enclosed viewing environments have focused on ambient light in the interior spaces of such viewing environments.

While it is necessary to control and minimize the ambient light, high contrast ratios of displayed images cannot be accomplished by dealing with the ambient light alone. Even in a completely dark room, a non-trivial amount of light diffused and reflected from the display screens can still traverse in an infinite number of optical paths within interior surfaces in enclosed viewing environment, and eventually reach the display screens, thereby reducing maximum contrast ratios of images displayed on the display screens.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1A:
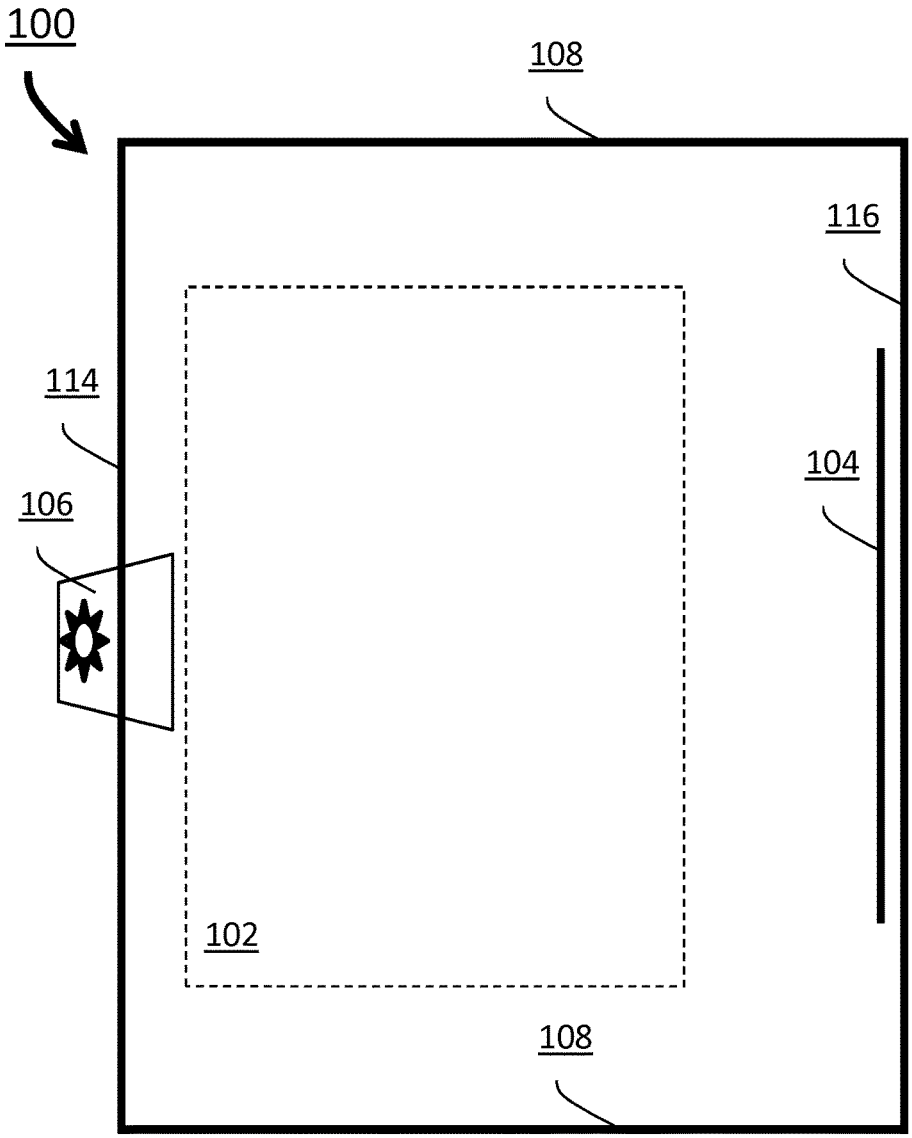
FIG. 1A and FIG. 1B illustrate example theater settings.

Example embodiments, which relate to improving contrast ratios in venues, theaters, auditoriums, etc., are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. THEATER SETTINGS
3. LIGHT ABSORBING STRUCTURES
4. LIGHT ABSORBING CONFIGURATIONS
5. EXAMPLE EMBODIMENTS
6. EQUIVALENTS, EXTENSIONS, ALTERNATIVES AND MISCELLANEOUS

1. General Overview

This overview presents a basic description of some aspects of an example embodiment of the present invention. It should be noted that this overview is not an extensive or exhaustive summary of aspects of the example embodiment. Moreover, it should be noted that this overview is not intended to be understood as identifying any particularly significant aspects or elements of the example embodiment, nor as delineating any scope of the example embodiment in particular, nor the invention in general. This overview merely presents some concepts that relate to the example embodiment in a condensed and simplified format, and should be understood as merely a conceptual prelude to a more detailed description of example embodiments that follows below.

Techniques as described herein provide a light absorbing configuration in a venue to prevent light reflected from a display screen from being reflected back to the display screen. As used herein, a screen or a display screen may refer to a reflective image rendering surface. Examples of screens include but are not limited to only, any of: canvases, image rendering spatial layers, image rendering spatial regions, over walls, painted surfaces, liquid, vapor, gas, suspended particulates, skin, etc. For the purpose of illustration only, a display screen as described herein may be placed at the front of a theater. For the purpose of the invention, however, a display screen can be placed anywhere in an observer or viewer's or environment. For example, in various embodiments, a display screen as described herein may be placed in any of ceiling, floor, all walls, etc., in a viewing environment. Further, a display screen may cover any portion of an observer or viewer's viewing sphere such as flat, curved, etc. The coverage of the display screen may, but is not required to be, continuous; therefore, a display screen may comprise a single contiguous display portion, or alternatively multiple disjoint display portions, for example, along with one or more projection devices. Multiple continuous or discontinuous screens may also be used in a venue as described herein. A non-limiting example is a situation where there is a screen on the front wall of a venue and additional screens to other walls or sides of the venue. Examples of venues include not only indoor environments such as theaters, auditoriums, etc., but also outdoor environments such as concert, theme park, etc. In some environments such as certain outdoor environments, a display screen may or may not be completely enclosed by a physical structure (comprising a ceiling, floor, walls, etc.) to which a light absorbing configuration is to be applied. For example, in an example outdoor venue, the display screen can be placed on stage while light absorbing/reflecting structures under techniques as described herein can be constructed around or near the display screen, around or near the audience section, over the floor of the venue, above or behind the audience or the display screen, etc. Venues as described herein also may include various 2D/3D, 4D, and simulator type rides, for example, deployed at various theme parks. Additionally, optionally or alternatively, techniques as described herein can be deployed at venues with other types of rides in which riders can view high quality, high contrast images. Likewise, light absorbing/reflecting structures under techniques as described herein may be floated on top of water, in front of a water screen, etc. at a theme park. As used herein, the term "theater" may refer to an enclosed or substantially enclosed space (e.g., a venue, a theater, an auditorium, etc.) in which an audience can view images projected onto the display screen by patterned light from a light projecting device. In some embodiments, the display screen can be located at or near a front (side) of the theater.

The light absorbing configuration comprises light absorbing structures deployed on surface portions (e.g., walls, ceilings, floors, backs, etc.) in the interior space of the theater. These surface portions include, but are not limited to, front portions of walls, ceilings, or floors of the theater. As used herein, a front portion refers to a surface portion that is located in the closest portion of the theater in front of the display screen. Since a front portion of walls, ceilings, or floors of the theater has a relatively large solid angle with respect to the display screen unit-wise, in order to reduce light reflections back to the display screen, in some embodiments, more light absorbing structures can be deployed in the front portions (e.g., the first 25%, the first 30%, the first 40%, etc.) of walls, ceilings, or floors of the theater than elsewhere.

A light absorbing surface structure can be one of a variety of designs such as symmetric pyramids, asymmetric pyramids, trapezoids, planar surface segments, curved surface segments such as those approximating trapezoids, etc. The light absorbing surface structure may be structured with grooves and positioned in such a way as to cause received light from the display screen to be trapped within the grooves for a minimum number (e.g., 2, 3, 4, 5+, etc.) of internal reflection (within the grooves). In some embodiments, the depth of a groove can be selected in relation to (e.g., twice or more of, etc.) the width or opening of the groove.

In some embodiments, the light absorbing surface structure is polished to be specular for light reflection. To absorb light, light reflectance of the light absorbing surface structure can be limited below a certain value such as 15%, 10%, 5%, etc. Thus, for example, a light absorbing surface structure with 10% light reflectance for a single reflection can produce light reflectance of less than 0.1% for three (3) or more internal reflections within a groove in the light absorbing surface structure. In some embodiments, different portions of sides that form a groove can have similar degrees of polish. In some other embodiments, different portions of sides that form a groove can have variable degrees of polish. For example, portions of a side that are at or near the opening of a groove for receiving light from the display screen can be relatively more polished than other portions of the side that are away from the opening of the groove. In some embodiments, because a light absorbing surface structure as described herein is relatively polished, it is relatively easy to clean or vacuum such a structure in a theater environment.

A variety of dimensions can be used for a groove in the light absorbing surface structure. For example, the size of the groove can be set to much larger (e.g., 10+ micrometers, etc.) than wavelengths of visible light (e.g., 0.7 micrometers, etc.), up to tens of centimeters.

In some embodiments, a light absorbing structure comprises a pattern of grooves formed by one, two or more types of sides (vertical sides, inclined sides, curved sides, etc.). Adjacent sides form edges that are in the line of sight from the display screen. To reduce light reflection, these edges can be made relatively pointed and small, for example, at a ratio of 1:10, 1:20, etc., relative to the sizes or pitches of the grooves. In some embodiments, these edges can be made large enough to be sturdy for cleaning.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Theater Settings

Figure 1B:
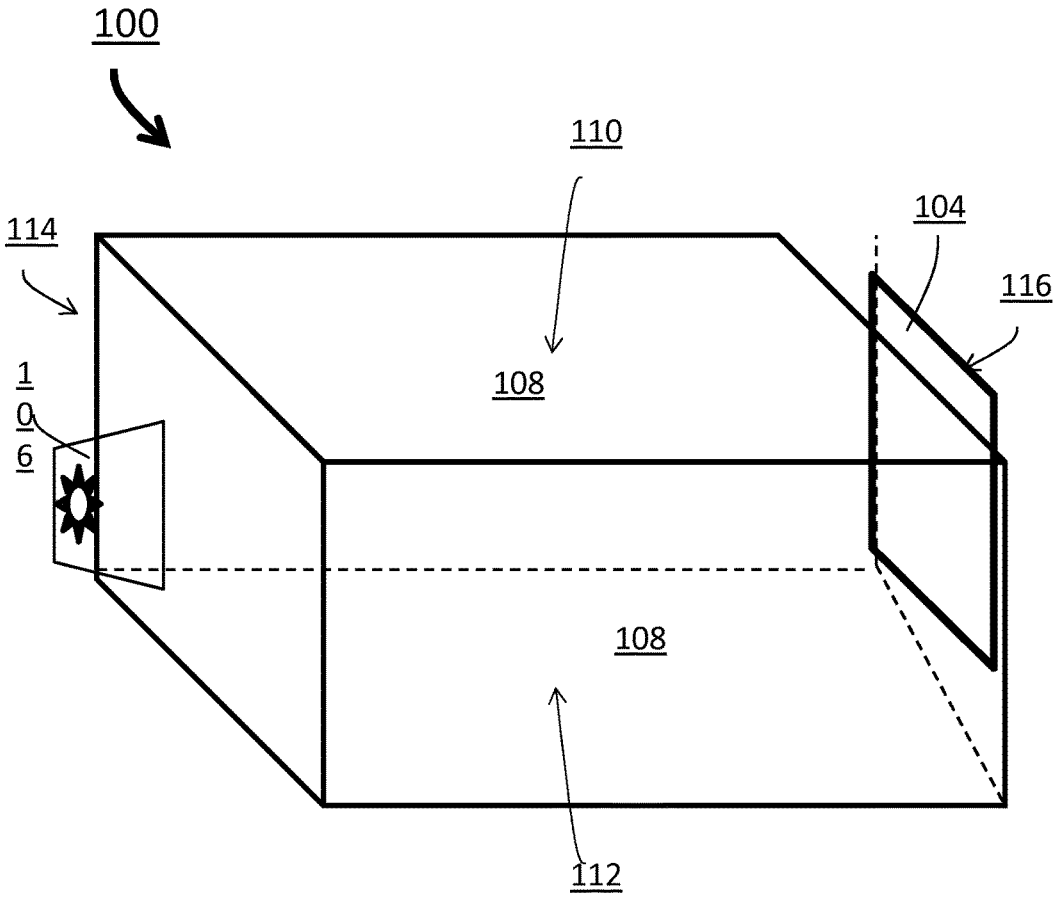

FIG. 1A depicts a plan view of an example theater 100 in which audience may sit in an interior area 102 to view projected images on a reflective screen 104. FIG. 1B depicts an example isometric view of the theater (100). The images can be projected onto the reflective screen (104) with light patterns emitted by one or more light projecting devices 106.

In some embodiments, the theater (100) is used to present high dynamic range projected images on the reflective screen (104) which diffusively reflects relatively intense light towards the audience as well other parts such as walls, ceiling, floor, clothing worn by the audience, etc., of the theater (100).

Light in the theater (100)—including but not limited to ambient light (e.g., originated from light sources other than the light projecting devices (106), etc.), the reflected light from the reflective screen (104), etc.—may traverse along many different optical paths in the interior of the theater (100) as bounded by side walls 108, a ceiling 110, a floor 112, a back wall 114, and a front wall 116. The portions of the light in the theater (100) that are sent from the light sources (106) to the reflective screen (104) for the first time (e.g., in the first pass, etc.) for rendering images are not to be affected or reduced by techniques as described herein. Similarly, the portions of the light in the theater (100) that are reflected from the reflective screen (104) to the audience (e.g., in the interior area 102, etc.) for the first time (e.g., in the first pass, etc.) for rendering images are not to be affected or reduced by techniques as described herein. However, other portions (e.g., ambient light, etc.) of the light in the theater (100) that are not sent from the light sources (106) to the reflective screen (104) for the first time (e.g., in the first pass, etc.) for rendering images may incident onto the reflective screen (104), get mixed with the portions of the light in the theater (100) that are sent from the light sources (106) to the reflective screen (104) for the first time (e.g., in the first pass, etc.) for rendering images, and raise the darkest level achievable on the projected screen (104), thereby reducing maximum contrast ratios of the projected/rendered images on the projected screen (104).

Ray tracing analyses of theaters, auditoriums, etc., reveal that maximum contrast ratios of the projected images are severely impacted by reflections (e.g., the above-mentioned reflected light, etc.) from interior surfaces such as the side walls (108), the ceiling (110), etc. Controlling ambient light (e.g., originated from light sources other than the light projecting devices (106), etc.) is not sufficient to assure relatively high contrast ratios.

Techniques as described herein can be used to increase maximum contrast ratios of projected images by reducing/absorbing reflected light from the reflective screen (104) that is not directed to the audience for image rendering purposes. It should be noted that the reflected light from the reflective screen (104) to be reduced under these techniques is not the light from the light sources (106) to the reflective screen (104) for the first time (e.g., in the first pass, etc.) for rendering images. In some embodiments, the techniques as described herein can be applied in a manner that does not hinder the transmission of the light from the light sources (106) to the reflective screen (104) for the first time (e.g., in the first pass, etc.) for rendering images and/or the transmission of the reflected light from the reflective screen (104) to the audience for the first time (e.g., in the first pass, etc.) for rendering images.

In some embodiments, in order to reduce reflected light, dark surfaces are used throughout the theater (e.g., 100 of FIG. 1A and FIG. 1B, etc.). Contrast ratios of around 5000:1 for a 4% Average Picture Level (APL) can be achieved using the best (e.g., 0.5% reflective, 5% reflective, etc.) flat black surfaces. The contrast ratios can be reduced to some extent by a variety of factors including white shirt effects from audience's clothing, curved display screens, etc. Ray tracing analyses show that these effects are relatively small in theaters (e.g., 100 of FIG. 1A and FIG. 1B, etc.) in comparison to reflected light off surfaces very close to display screens (e.g., 104 of FIG. 1A and FIG. 1B, etc.). The analyses show that in an example theater such as 100 of FIG. 1A and FIG. 1B, about 70% of the reflected light causing a loss in contrast comes from the walls (108), floor (112) and ceiling (110) located within 25% of the length (between the back and the front) of the theater (100) nearest the display screen (104). Thus, if this portion (e.g., 70%, etc.) of the reflected light from the front portion (e.g., 25%, etc.) of the theater (100) could be completely eliminated, contrast ratios can be improved by a substantial factor (e.g., 3, etc.).

In some embodiments, some or all of the walls (108), floor (112) and ceiling (110)—e.g., a front portion of the theater (100) nearest the display screen (104), etc.—can be painted glossy black paint. As this type of paint has a substantially specular reflection, light rays coming from the display screen (104) that are incident on the walls (108), floor (112) and ceiling (110) with the glossy black paint bounce further into the interior of the theater (100) away from the display screen (104), while at the same time losing most of the light rays' energies (e.g., 90%, 95%, etc.). Two or more lossy reflections occur before these rays can be reflected back to the display screen (104); and the energies of these rays are reduced by the product of reflectance of the two or more reflections. A variety of light absorbing materials, such as plastic, carbon, wood, nanotubes, etc., other than glossy black paint, can also be used on some or all of the walls (108), floor (112) and ceiling (110)—e.g., a front portion of the theater (100) nearest the display screen (104), etc.

However, while contrast ratios of the projected images rendered on the display screen are improved, a blurry image of the display screen may become visible on the walls (108). In addition, light reflections from the walls (108) and ceiling (110) can reach the audience; thus, the walls (108) and ceiling (110) may appear distractively well lit from the audience viewpoint.

In some embodiments, glossy black paint can be used on portions of the walls (108), ceiling (110), and floor (112) very close to (e.g., at or nearby the same plane with, etc.) the display screen (104). For example, glossy black paint can be applied in theater areas in which light reflections from these surfaces do not reach the audience to form any blurry image of the display screen (104). A variety of light absorbing materials, such as plastic, carbon, wood, nanotubes, etc., other than glossy black paint, can also be used on portions of the walls (108), ceiling (110), and floor (112) very close to (e.g., at or nearby the same plane with, etc.) the display screen (104).

In some embodiments, a front portion (e.g., the first quarter, the front quarter nearest to the display screen (104), etc.) of the theater (100) can comprise surfaces with light absorbent material, features, structures, etc., that have very low light reflections as seen from the display screen (104), which is an important criterion for increasing the contrast at the screen.

3. Light Absorbing Structures

Figure 2:
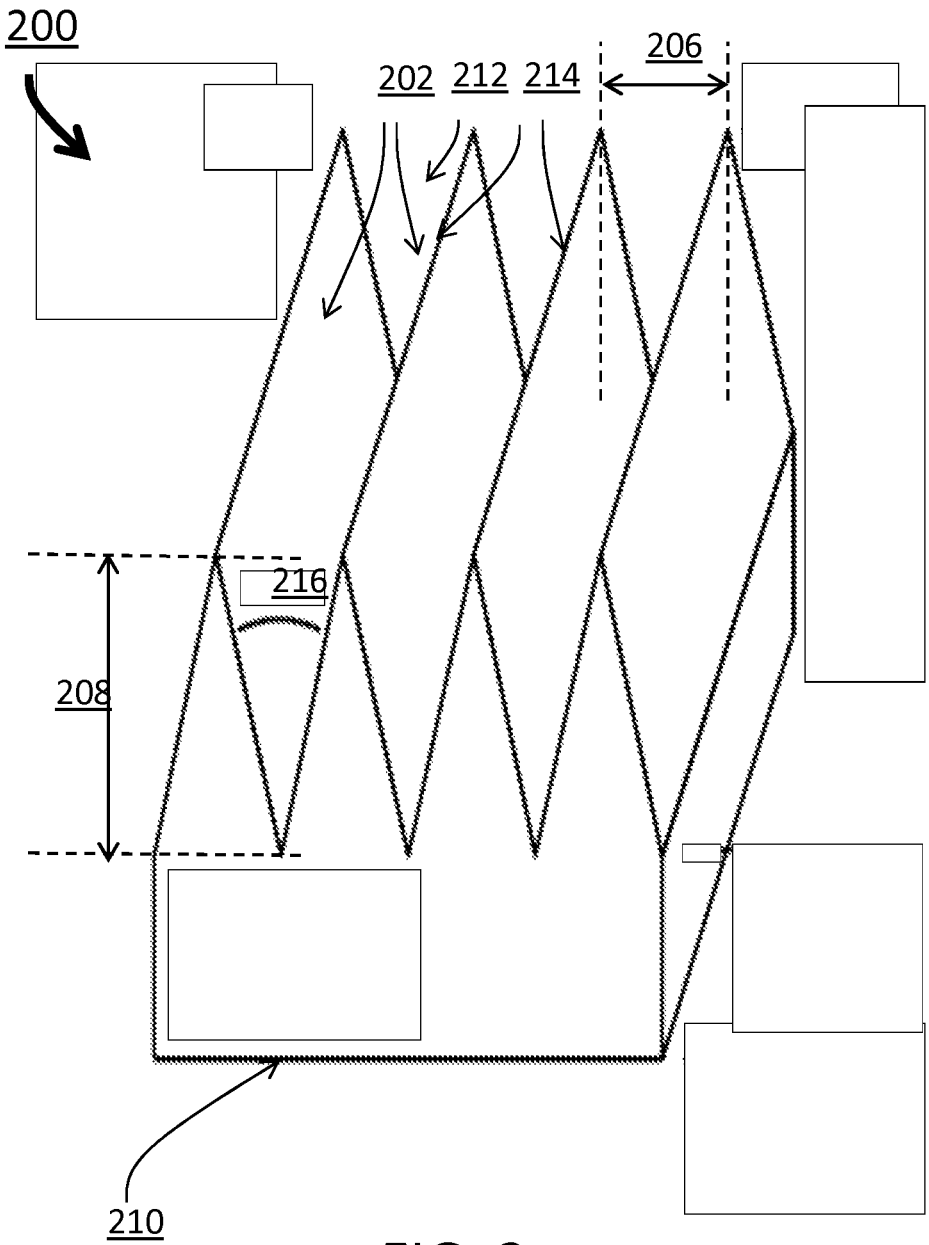
FIG. 2 illustrates an example light absorbing structure.

In some embodiments, some or all surfaces (e.g., walls, ceiling, floor, etc., of a front portion, etc.) in the theater (100) can comprise a structure 200 as shown in FIG. 2. One or more of a wide variety of dimensions, sizes, etc., can be used by the structure (200). The shape and smoothness of sides 202 of the structure (200) can be specifically selected for absorbing incident light. In some embodiments, all of the sides (202) are inclined or slanted relative to a base 210 of the structure (200). In some embodiments, the sides (202) of the structure (200) are very specular (mirror like). The structure (200) can be configured with grooves 212 (air gaps or optical cavities formed between adjacent sides in the sides 202) formed by the sides (202). Edges 214 at which the sides (202) join can be relatively sharp with respect to pitches 206 (or sizes; or widths) of the grooves (212) in the structure (200). The pitches (206) can be as small as ten microns and scaled up to be feet, inches, etc. Depths 208 of the grooves can be comparable, or proportional, to the sizes of grooves (212). In some embodiments, the depths (208) of the grooves (212) are two times, three times, etc., of the pitches (206) of the grooves (212).

This structure (200) can be designed to be absorptive from all angles. In some embodiments, the depths (208) of the grooves (212) are arranged to be parallel (across the theater from one side wall to the other side wall) with the display screen (104). Bottoms of the grooves (212) may, but need not, use sharp transitions. Additionally, optionally, or alternatively, angles 216 may, but need not use, a particular value such as 22.5 degrees. The grooves may, but need not, be symmetric. In the theater (100), symmetry of the grooves in the structure (200) may produce more light reflected back to the display screen (104) than asymmetrical structures.

Figure 3A:
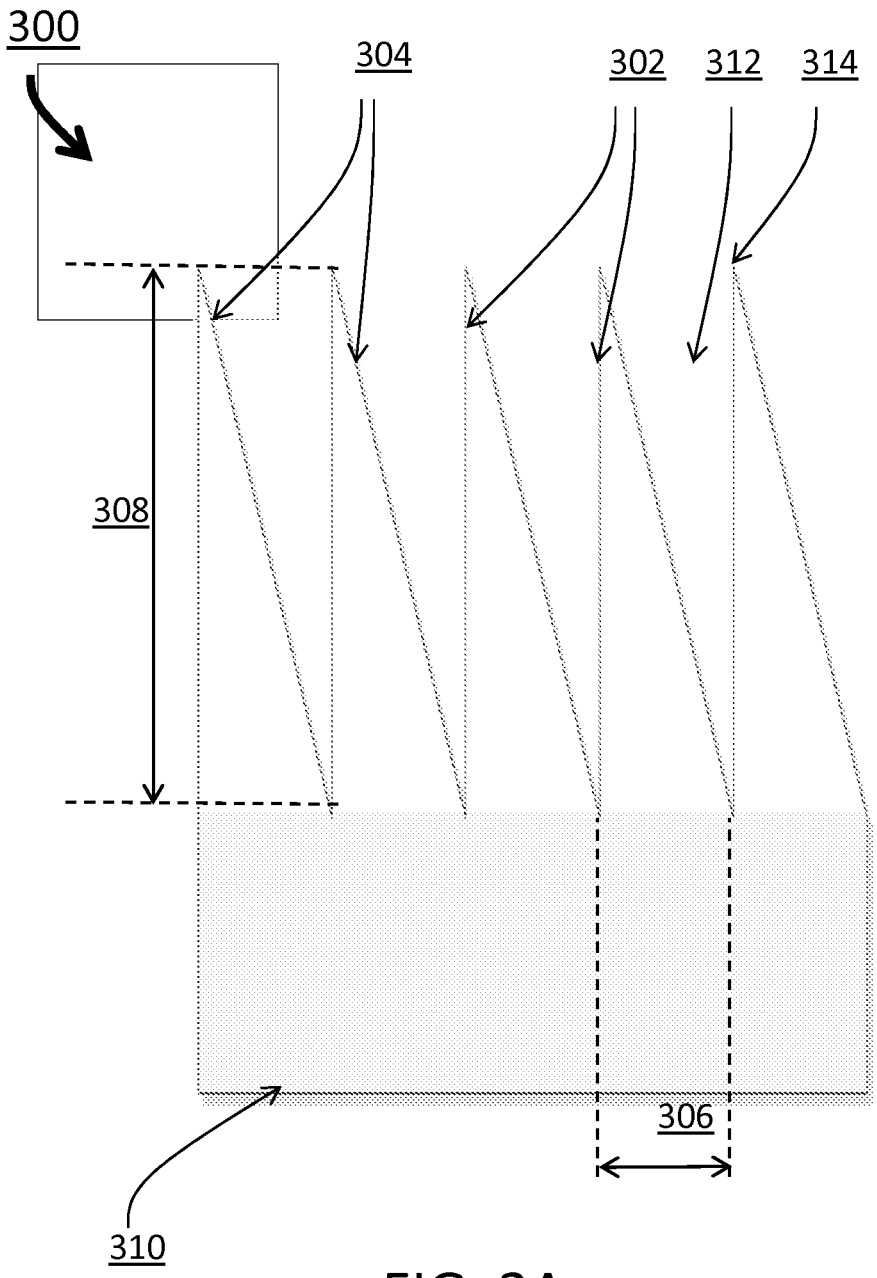
FIG. 3A illustrates an example light absorbing structure.

FIG. 3A illustrates an example structure 300 of surfaces of the theater (100). One or more of a wide variety of dimensions, sizes, etc., can be used by the structure (300). The shape and smoothness of vertical sides 302 (vertical or perpendicular relative to a base 310) and inclined sides 304 (inclined or slanted relative to a base 310) of the structure (300) can be specifically selected for absorbing incident light. In some embodiments, the vertical sides (302) and the inclined sides (304) of the structure (300) are very specular (mirror like). The structure (300) can be configured with grooves 312 (air gaps or optical cavities formed between adjacent sides) formed by the vertical sides (302) and the inclined sides (304). Edges 314 at which the vertical sides (302) and the inclined sides (304) join can be relatively sharp with respect to pitches 306 (or sizes; or widths) of the grooves (312) in the structure (300). The pitches (306) can be as small as ten microns and scaled up to be feet, inches, etc. Depths 308 of the grooves (312) can be comparable, or proportional, to the pitches (306) of grooves. In some embodiments, the depths (308) of the grooves (312) are 2 times, 3 times, etc., the pitches (306) of the grooves (312).

Figure 3B:
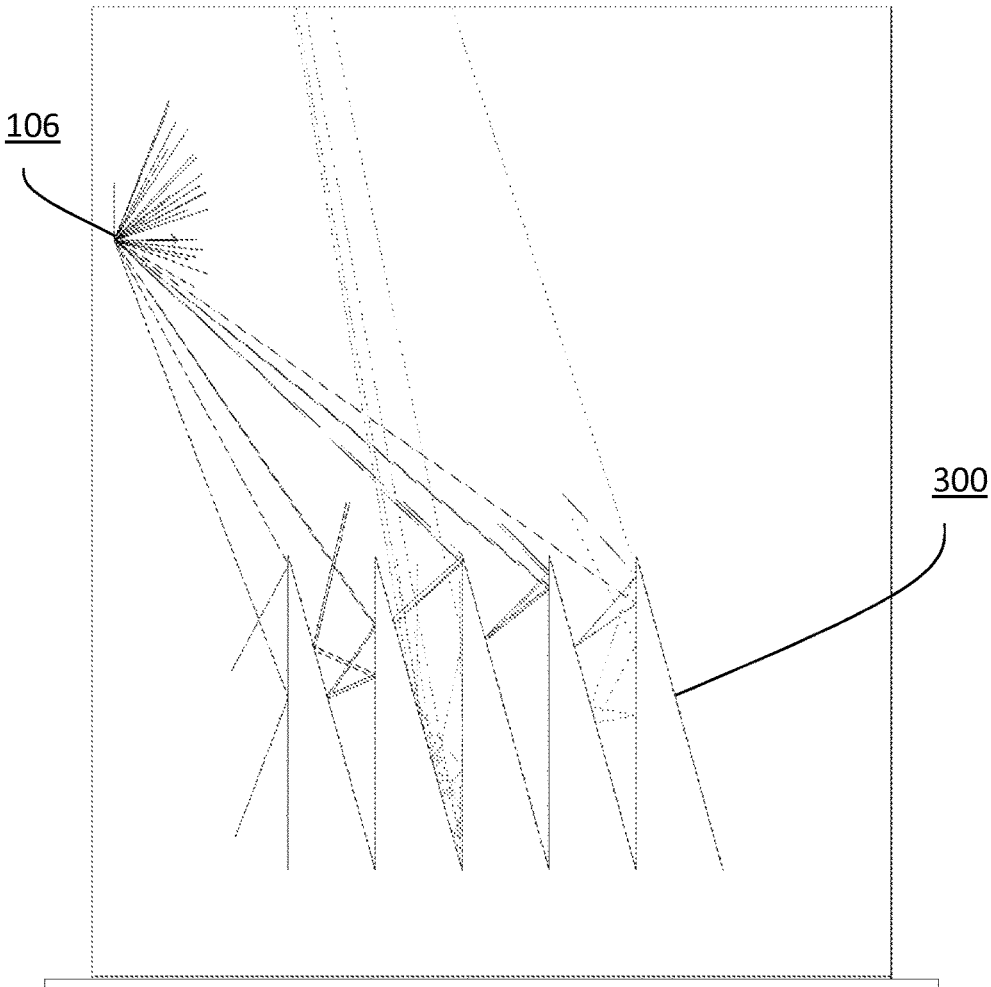
FIG. 3B illustrates example ray tracing in the light absorbing structure of FIG. 3A.

In some embodiments, a display screen (e.g., 104 of FIG. 1A and FIG. 1B, etc.) is located to the left of this structure (300). FIG. 3B illustrates example ray tracing with the structure (300) for light coming from such a display screen (e.g., 104 of FIG. 1A and FIG. 1B, etc.). As shown, the structure (300) can be configured to cause light rays incident on the vertical sides (302) from the display screen (104) to have a minimum number (e.g., 2, 3, etc.) of reflections before any portion of the light rays being reflected back onto the display screen (104).

In some alternative embodiments, the display screen (104) is located to the right (instead of left) of this structure (300). The structure (300) can be configured to cause light rays incident on the inclined sides (304) from the display screen (104) to have a minimum number (e.g., 2, 3, etc.) of reflections before any portion of the light rays being reflected back onto the display screen (104).

This structure (300) can be designed to be absorptive from all angles. However, it may be more absorptive from angles where the grooves run parallel to the screen than otherwise. In some embodiments, the depths (308) of the grooves (312) are arranged to be parallel (across the theater from one side wall to the other side wall) with the display screen (104). Bottoms of the grooves (312) may, but need not, use sharp transitions.

For the purpose of illustration only, if the structure (300) has a reflectivity of 10%, then the maximum reflectivity from the screen direction may be no more than 0.1%. This is much better than flat glossy black paint which may reflect around 1-5% of incident light (depending upon the incident angle) back to the display screen (300).

Figure 4A:
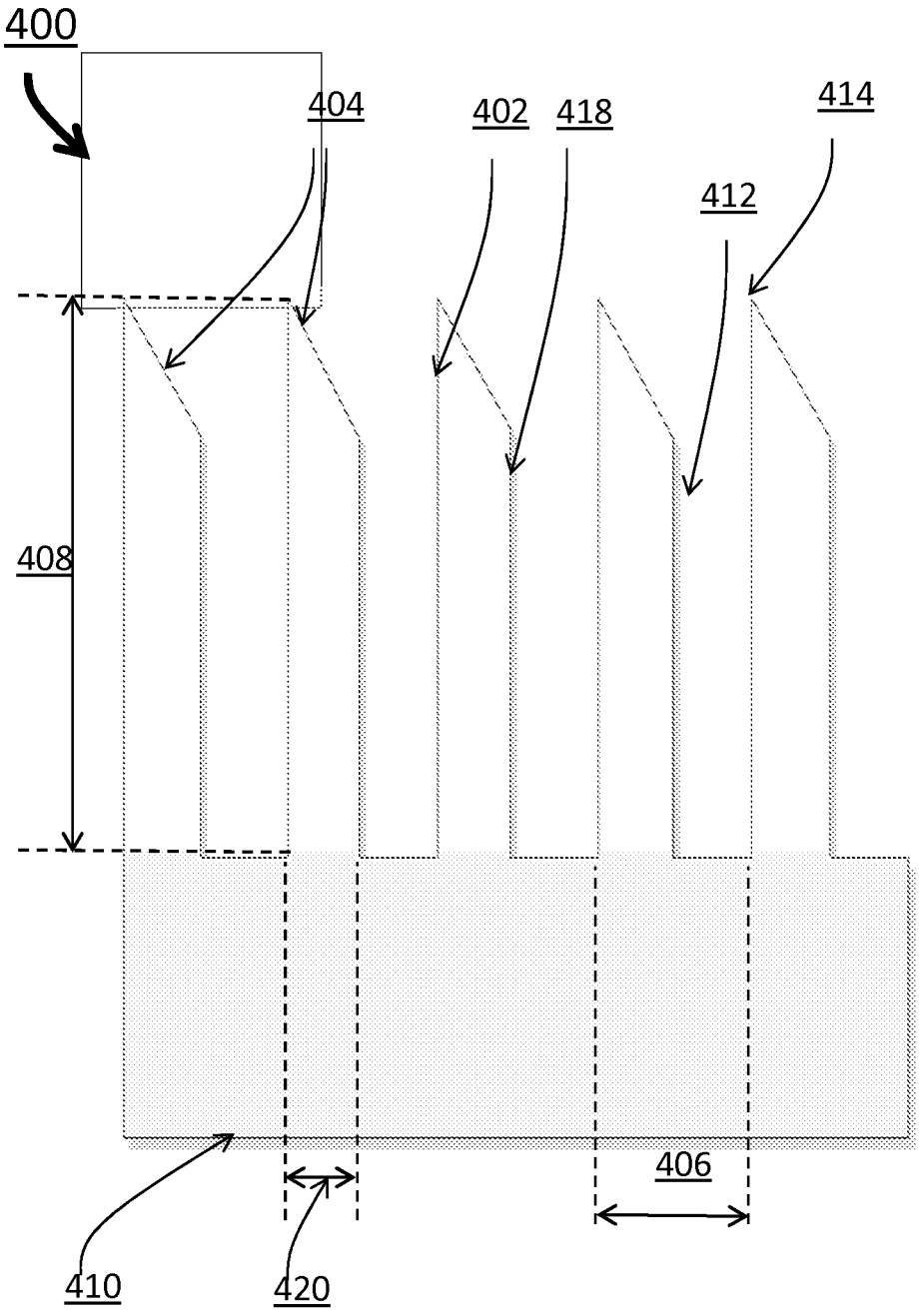
FIG. 4A illustrates an example light absorbing structure.

FIG. 4A depicts another example structure 400 of surfaces of the theater (100). One or more of a wide variety of dimensions, sizes, etc., can be used by the structure (400). The shape and smoothness of first vertical sides 402, second vertical sides 418 (vertical or perpendicular relative to a base 410), and inclined sides 404 (inclined or slanted relative to a base 410) of the structure (400) can be specifically selected for absorbing incident light. In some embodiments, the vertical sides (402 and 418) and the inclined sides (404) of the structure (400) are very specular (mirror like). The structure (400) can be configured with grooves 412 (air gaps or optical cavities formed between adjacent sides) formed by the vertical sides (402 and 418) and the inclined sides (404). Edges 414 at which the first vertical sides (402) and the inclined sides (404) join can be relatively sharp with respect to pitches 406 (or sizes; or widths) of the grooves (412) in the structure (400). The pitches (406) can be as small as microns, or sub-micros, and can be scaled up to be feet, inches, etc. Depths 408 of the grooves (412) can be comparable, or proportional, to the pitches (406) of grooves. In some embodiments, the depths (408) of the grooves (412) are two times, three times, etc., of the pitches (406) of the grooves (412). In some embodiments, heights 420 of trapezoids formed by the vertical sides (402 and 418) and the inclined sides (404) can be relatively thin as compared with the pitches (406) of the grooves (412). In some embodiments, the larger the depths (408) are, the thinner the heights (420) of the trapezoids can be. For example, the heights (420) of the trapezoids can be inversely proportional to the depths (408) of the grooves (412).

Figure 4B:
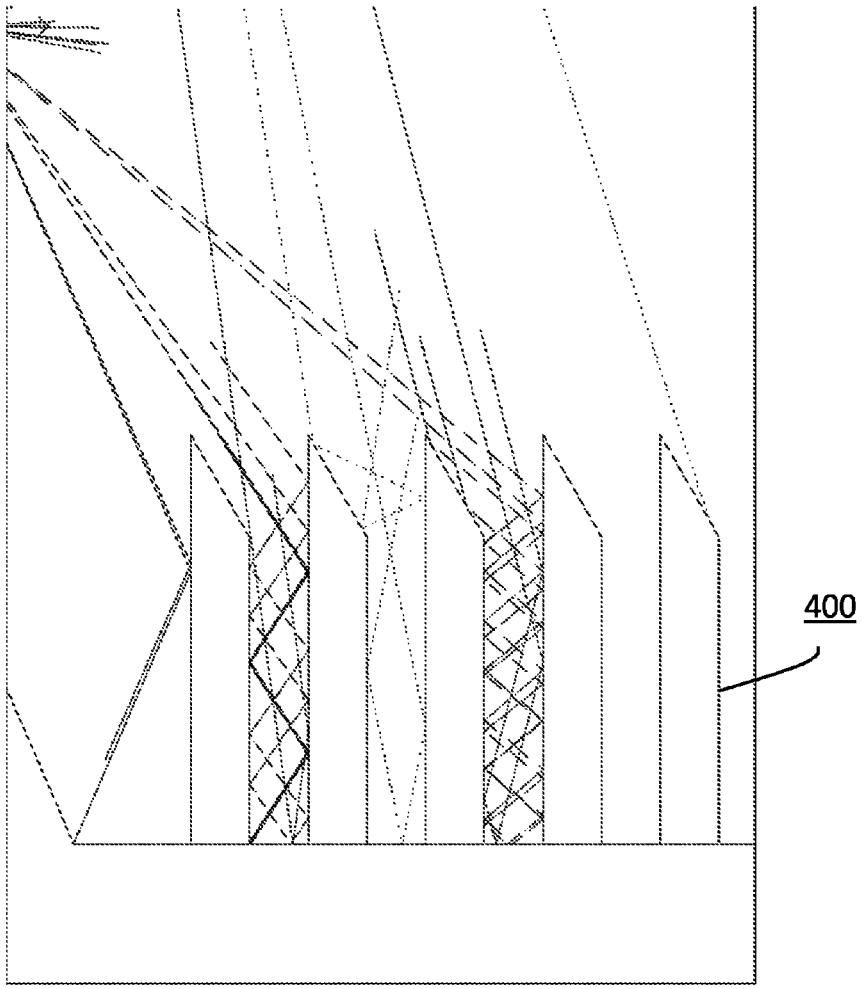
FIG. 4B illustrates example ray tracing in the light absorbing structure of FIG. 4A.

In some embodiments, a display screen (e.g., 104 of FIG. 1A and FIG. 1B, etc.) is located to the left of this structure (400). FIG. 4B illustrates example ray tracing with the structure (400) for light coming from such a display screen (e.g., 104 of FIG. 1A and FIG. 1B, etc.). As shown, the structure (400) can be configured to cause light rays incident on the first vertical sides (402) from the display screen (104) to have a minimum number (e.g., 2, 3, etc.) of reflections before any portion of the light rays being reflected back onto the display screen (104).

In some alternative embodiments, the display screen (104) is located to the right (instead of left) of this structure (400). The structure (400) can be configured to cause light rays incident on the inclined sides (404) and even the second vertical sides (418) from the display screen (104) to have a minimum number (e.g., 2, 3, etc.) of reflections before any portion of the light rays being reflected back onto the display screen (104).

The structure (400) comprises a relatively large air gap or optical cavity as compared with the structure (300); is configured to effectively absorb incident light; and is also somewhat easier to manufacture, for example, with injection molding, extrusion molding, etc. The structure may be made using one or more of a variety of light absorbing materials, such as glossy black paint, plastic, carbon, wood, nanotubes, etc.

4. Light Absorbing Configurations

In some embodiments, light absorbing structures as described herein can be implemented in panels, subpanels, tiles, etc. These panels, subpanels, tiles, etc., can be placed in the first quarter, the first third, the first half, the front portion, etc., (relative to a display screen such as 104 of FIG. 1A and FIG. 1B) of a theater (e.g., 100 of FIG. 1A and FIG. 1B, etc.) in as many places as possible.

In an example, panels, subpanels, tiles, etc., made with any of designs of structures as described herein can be made into planar or curved shapes that fit in hung ceilings in a variety of theaters (e.g., 100 of FIG. 1A and FIG. 1B, etc.). Installation of such structures on hung ceilings can reduce a substantial portion of reflected light that may be reflected back to a display screen (e.g., by about a ⅓ as ceiling surfaces represent about ⅓ of the reflection surface close to the display screen, etc.).

In some embodiments, black cloth can be used to cover some or all portions (e.g., back portions, portions not covered with structures as described herein, etc.) of walls, ceilings, and floors of a theater to achieve a certain maximum contrast ratio (e.g., 5000:1, etc.) for a certain APL (e.g., 4%, etc.); adding/deploying these light absorbers in hung ceiling can substantially improve the maximum contrast ratio (e.g., 7500:1, etc.).

In an example, panels, subpanels, tiles, etc., made with any of designs of structures as described herein can be made into planar or curved shapes that fit in side walls in a variety of theaters (e.g., 100 of FIG. 1A and FIG. 1B, etc.). Installation of such structures on side walls can reduce a substantial portion of reflected light that may be reflected back to a display screen (e.g., by about a ⅓ as side wall surfaces represent about ⅓ of the reflection surface close to the display screen, etc.). As a result, adding structures as described herein to the side walls can further increase the maximum contrast ratio (e.g., to about 10,000:1, etc.).

While floor surfaces are more challenging than ceiling surfaces and side wall surfaces because of possible foot traffic access, structures as described herein can still be installed on floor surfaces. For example, materials, sizes, dimensions, etc., in the installed structures can be preselected so that floor surfaces with these installed structures remain walkable and sturdy.

In many a theater, walking surfaces allow access to a display screen, and thus the areas near the display screen can be walked upon. In this type of theater, the area near the display screen may be covered with black carpet. In other theaters that have an area that is blocked to foot traffic in front of a display screen (usually to keep people from touching the screen); the area can be covered or populated with light absorbing panels with structures as described herein. In addition, any area in a theater that faces a display screen, and subtends a relatively large solid angle (from the screen's viewpoint) other than a solid angle to the audience can also be configured with structures as described herein. In some circumstances, the floor may represent a third of the reflective surfaces close to the display screen. Techniques for reducing/absorbing reflected light from the display screen not directed to the audience for image rendering purposes for the first time can be applied to ceiling and walls as well as the floor in order to improve the maximum contrast ratios of the display screen.

5. Example Embodiments

Figure 1C:
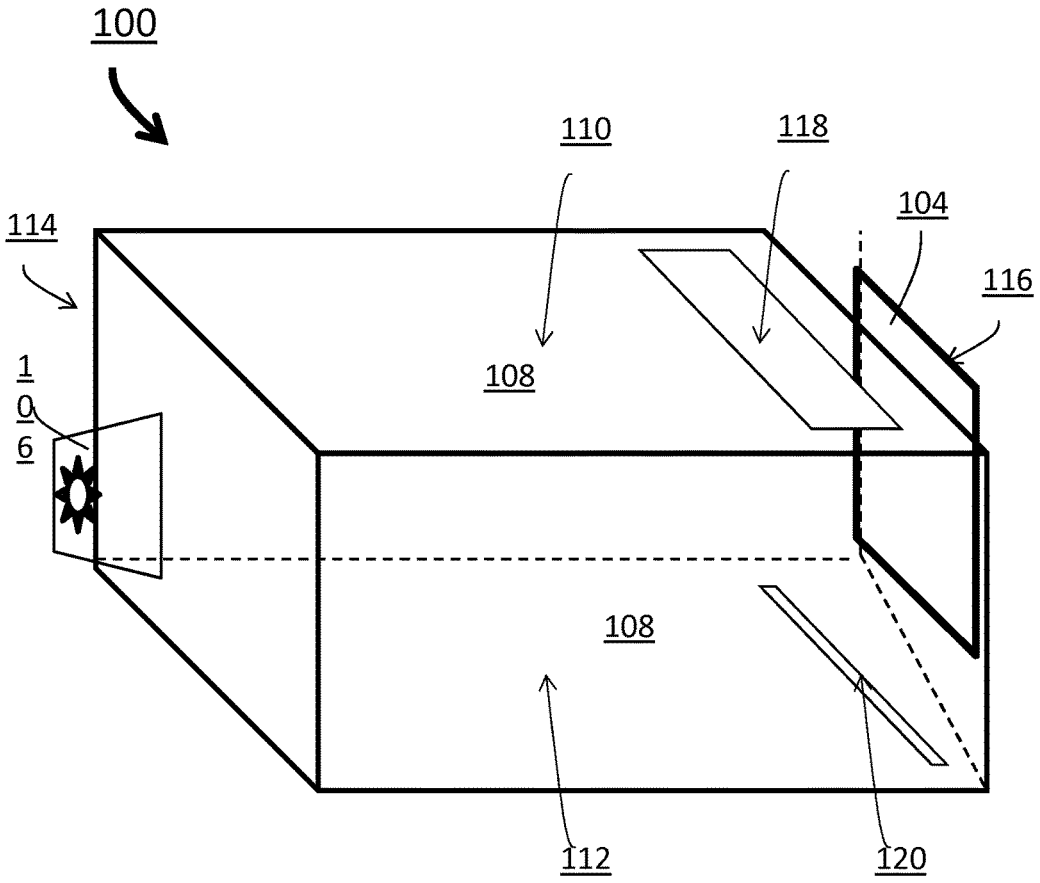
FIG. 1C and FIG. 1D illustrate example light absorbing configurations.
Figure 1D:
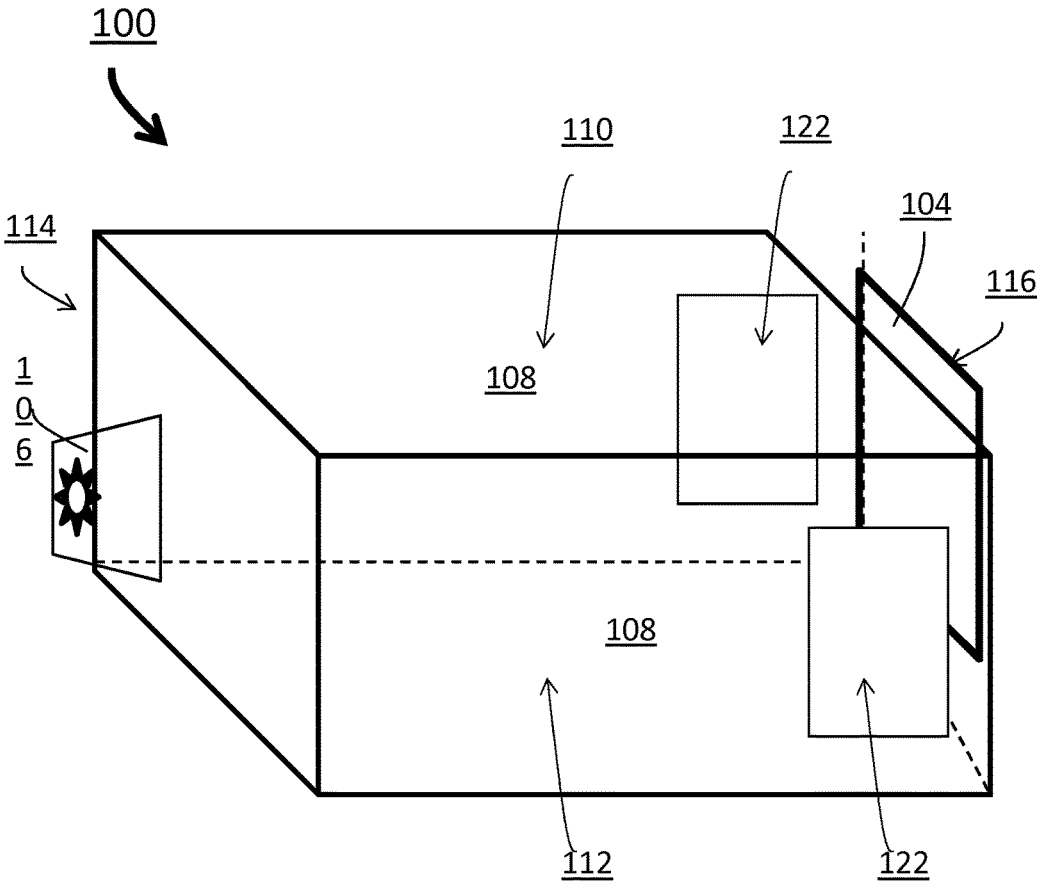

In an embodiment, a light absorbing configuration (e.g., FIG. 1C, FIG. 1D, etc.) for a theater (e.g., any of FIG. 1A through FIG. 1D, etc.), in which images are projected to a display screen (e.g., 104, etc.) located at or near a front (e.g., at or near front wall 116, etc.) of the theater, comprises: a light absorbing structure (e.g., FIG. 2, FIG. 3A, FIG. 4A, etc.) deployed on one or more front portions (e.g., 118 and 120 of FIG. 1C, 122 of FIG. 1D, etc.) on one or more of a ceiling (e.g., 110, etc.), side walls (e.g., 108, etc.), or a floor (e.g., 112, etc.) of the theater; the light absorbing structure comprises grooves (e.g., 212, 312, 412, etc.) formed at least in part by a first type of light reflective surfaces (e.g., 202, 302, 402, etc.) configured to receive a portion of light rays directly reflected off the display screen and a second type of light reflective surfaces (e.g., 202, 304, 404, etc.) configured to receive light rays reflected off the first type of light reflective surfaces.

In an embodiment, the light absorbing structure is rigid.

In an embodiment, the first type of light reflective surfaces forms one or more acute angles with the second type of light reflective surfaces.

In an embodiment, a groove in the grooves formed by the first type of light reflective surfaces and the second type of light reflective surfaces is configured to trap incident light received on the first type of light reflective surfaces for two or more internal reflections within the groove.

In an embodiment, a depth of a groove in the grooves formed by the first type of light reflective surfaces and the second type of light reflective surfaces is proportional to a width of the groove.

In an embodiment, at least one of the first type of light reflective surfaces or the second type of light reflective surfaces has a light reflectance value below one of 30%, 20%, 10%, or 5%.

In an embodiment, at least one of the first type of light reflective surfaces or the second type of light reflective surfaces is covered with glossy black paint.

In an embodiment, at least one of the first type of light reflective surfaces or the second type of light reflective surfaces is specular.

In an embodiment, the first type of light reflective surfaces is parallel to the display screen. In an embodiment, the first type of light reflective surfaces forms one or more acute angles with the display screen.

In an embodiment, the light absorbing structure is deployed on one or more other portions on one or more of a front, a back, the ceiling, the side walls, or the floor of the theater.

In an embodiment, the images projected onto the display screen are high dynamic range images.

In an embodiment, the theater comprises an interior space substantially enclosed.

In an embodiment, the first type of light reflective surfaces is vertical to and the second type of light reflective surfaces is configured to trap incident light received on the first type of light reflective surfaces for two or more internal reflections within the groove.

6. Equivalents, Extensions, Alternatives and Miscellaneous

In the foregoing specification, example embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A light absorbing configuration for a venue in which images are projected to a display screen, comprising:

a light absorbing structure deployed on one or more portions on one or more of a ceiling, side walls, or a floor of a venue;

wherein the light absorbing structure comprises grooves formed at least in part by a first type of light reflective surfaces configured to receive a portion of light rays directly reflected off the display screen and a second type of light reflective surfaces configured to receive light rays reflected off the first type of light reflective surfaces.

2. The light absorbing configuration as recited in claim 1, wherein the light absorbing structure is rigid.

3. The light absorbing configuration as recited in claim 1, wherein the first type of light reflective surfaces forms one or more acute angles with the second type of light reflective surfaces.

4. The light absorbing configuration as recited in claim 1, wherein a groove of the grooves formed by the first type of light reflective surfaces and the second type of light reflective surfaces is configured to trap incident light received on the first type of light reflective surfaces for two or more internal reflections within the groove.

5. The light absorbing configuration as recited in claim 1, wherein a depth of a groove in the grooves formed by the first type of light reflective surfaces and the second type of light reflective surfaces is proportional to a width of the groove.

6. The light absorbing configuration as recited in claim 1, wherein at least one of the first type of light reflective surfaces or the second type of light reflective surfaces has a light reflectance value below one of 30%, 20%, 10%, or 5%.

7. The light absorbing configuration as recited in claim 1, wherein at least one of the first type of light reflective surfaces or the second type of light reflective surfaces is covered with glossy black paint.

8. The light absorbing configuration as recited in claim 1, wherein at least one of the first type of light reflective surfaces or the second type of light reflective surfaces is specular.

9. The light absorbing configuration as recited in claim 1, wherein at least one of the first type of light reflective surfaces or the second type of light reflective surfaces is diffusive.

10. The light absorbing configuration as recited in claim 1, wherein the first type of light reflective surfaces is parallel to the display screen.

11. The light absorbing configuration as recited in claim 1, wherein the first type of light reflective surfaces forms one or more acute angles with the display screen.

12. The light absorbing configuration as recited in claim 1, wherein the light absorbing structure is deployed on one or more other portions other than the one or more of a front, a back, the ceiling, the side walls, or the floor of the venue.

13. The light absorbing configuration as recited in claim 1, wherein the images projected onto the display screen are high dynamic range images.

14. The light absorbing configuration as recited in claim 1, wherein the venue comprises an interior space substantially enclosed.

15. The light absorbing configuration as recited in claim 1, wherein the first type of light reflective surfaces is vertical to and the second type of light reflective surfaces is configured to trap incident light received on the first type of light reflective surfaces for two or more internal reflections within the groove.

16. The light absorbing configuration as recited in claim 1, wherein the display screen is located at or near a front of the venue, and wherein the one or more portions on the one or more of the ceiling, the side walls, or the floor of the venue comprise one or more front portions on the one or more of the ceiling, the side walls, or the floor of the venue.

17. The light absorbing configuration as recited in claim 1, wherein the venue is an indoor viewing environment.

18. The light absorbing configuration as recited in claim 1, wherein the venue is one of a theater, au auditorium, a concert, or a park.

19. The light absorbing configuration as recited in claim 1, wherein the venue is an outdoor viewing environment.

* * * * *